US006375584B1

(12) United States Patent
Shapiro

(10) Patent No.: US 6,375,584 B1
(45) Date of Patent: Apr. 23, 2002

(54) TIMED PLACE KICKING PRACTICE DEVICE AND METHOD

(76) Inventor: Stan Lee Shapiro, 3215 N. 36$^{th}$ Ave., Hollywood, FL (US) 33021

( * ) Notice: Subject to any disclaimer, the term of this patent is extended or adjusted under 35 U.S.C. 154(b) by 0 days.

(21) Appl. No.: 09/649,439

(22) Filed: Aug. 25, 2000

(51) Int. Cl.$^{7}$ ..... A63B 69/00
(52) U.S. Cl. ..... 473/419; 473/439; 473/422
(58) Field of Search ..... 473/144, 147, 473/197, 415, 419–423, 220–222, 432, 43 E, 442, 477; 273/375, 392, 400, 407, 446, 454, 455; 434/247, 251

(56) References Cited

U.S. PATENT DOCUMENTS

| | | | | |
|---|---|---|---|---|
| 3,399,892 A | | 9/1968 | Jurkiewicz | |
| 3,700,238 A | | 10/1972 | Mathis | |
| 3,836,147 A | | 9/1974 | Shapiro | |
| 4,261,564 A | | 4/1981 | Holshan | |
| 4,477,079 A | * | 10/1984 | White | 473/221 |
| 4,534,557 A | * | 8/1985 | Bigelow et al. | 473/442 |
| 4,627,620 A | | 12/1986 | Yang | |
| 4,630,829 A | * | 12/1986 | White | 473/221 |
| 4,632,395 A | | 12/1986 | Ferrebee | |
| 4,775,151 A | | 10/1988 | Berry | |
| 4,836,542 A | | 6/1989 | Crawley | |
| 4,998,727 A | | 3/1991 | Person | |
| 5,280,904 A | | 1/1994 | Rodriguez | |
| 5,294,111 A | | 3/1994 | Bloch | |
| 5,685,782 A | * | 11/1997 | Lipps et al. | 473/220 |
| 5,688,196 A | * | 11/1997 | O'Neil | 473/439 |
| 5,697,791 A | * | 12/1997 | Nashner et al. | 473/248 |
| 6,045,464 A | * | 4/2000 | Crist, Jr. | 473/438 |
| 6,093,119 A | * | 7/2000 | Tipton | 473/221 |

* cited by examiner

*Primary Examiner*—Paul T. Sewell
*Assistant Examiner*—Mitra Aryanpour
(74) *Attorney, Agent, or Firm*—Malin, Haley & DiMaggio, P.A.

(57) ABSTRACT

An apparatus for enhancing in simulated real-time environment, the skills of a football place kicker, center and holder, particularly the speed, distance, direction and angle of the kicks, by simulating charging lineman and providing simultaneous and integrally connected, resettable, visually displayed split-time and total elapsed timing feedback comprising uprights, a cross bar supporting a net, actuator switches for cross bar, timing means, and time display and reset means on the time display.

14 Claims, 3 Drawing Sheets

TIMED PLACE KICKING PRACTICE DEVICE AND METHOD

BACKGROUND OF THE INVENTION

1. Field of the Invention

This invention relates generally to an improvement to a automatic practice device for improving the skill of a football place kicker, particularly the speed, distance, direction and angle of the kick, and to enhance timing and coordination between the center, holder, and kicker by simultaneously and integrally simulating charging lineman and providing immediate visual split-timing and total elapsed timing feedback to the kicker, center, and holder.

2. Description of the Prior Art

In assessing the expertise and success of field goal and points after touchdown kicks, it is critical that the kick be completed rapidly and at an appropriate angle so as to avoid being blocked by the oncoming rushing linemen of the opponent. It is also critical that the kick have enough distance and correct direction to reach and pass through the goal posts constructed in the end zone. Kickers need a great deal of practice to perfect these skills. A kicker's success in kicking is dependent, not only on his own skill in actually kicking the ball, but also on how well-timed and coordinated the actions of the center and holder are in quickly and accurately hiking and setting up the ball on the kicker's tee during the kicking process. Although necessary, it is difficult to afford the kicker consistent real-time practice because presence of the entire team of players is necessary to simulate actual game circumstances. Thus, often a field goal kicker's only exposure to a full team environment with rushing linemen is in an actual game. This is realistically not the place to practice or hone the kicker's skills, since obviously a lot is at stake, e.g. championships and money. The other players also require time to practice their respective skills which are most often not of the type that benefit from field goal practice.

A need therefore exists for a device and method to allow a kicker to practice without convening the entire team, in a manner which most closely resembles real game playing time and which gives immediate and comprehensive feedback on a multitude of critical skills which the kicker, center, and holder need to perfect in each kick in order to achieve a score, such as:

1) accurate timing of the kick: the faster the ball is hiked, set up, and kicked the less likely it is to be blocked.
2) the angle of the kick: the greater the angle from the ground the less likely the arms of the oncoming linemen will be to tip, deflect or block the ball.
3) the direction of the kick: the ball needs to pass between the goal posts to score.
4) The distance of the kick: if the ball is not kicked far enough it will not reach the goal posts and no score will be made.

Expertise in numerous athletic endeavors focuses on the time it takes to perform the task, thus knowledge by the athlete of this elapsed time is critical to perfecting the skill of the athlete. Kicking field goals and points after touchdown in the sport of football is no exception, and is a skill that is highly dependent on timing. Timing ability relates, not only to the immutable forward movement of time as measured and displayed by a timing device such as a clock, but also to the ability of one player to correlate or coordinate his actions with the action of another, eg. at the moment the center hikes the football, the holder prepares to catch it and the kicker begins to move toward the kicking area. The holder then proceeds to catch the ball and set it up in proper position on the platform as the kicker continues his stride in the kicking process toward the tee and then follows through with the kick, within a matter of a few seconds. Should the center or holder bungle the snap, catch and/or set-up of the football, the football may not be available at the time the kicker reaches it anticipating its presence there and the higher is the likelihood that the kick will be blocked because of the time delay and lack of coordination. Thus, it is critical that all three players cooperate and coordinate their actions and timing so that a successful kick and score can result.

Field goal kickers as a rule kick the football as hard as they are able on each kick regardless of the distance the football is from the goalposts. The vertical angle of the kick is critical due to the charging oncoming linemen of the opponent who are attempting to block the kick and not only keep the opponent from scoring points for the successful field goal or point after touchdown, but also to potentially obtain possession of the football as a result of the blocked kick. Thus, it is imperative that the kicker kick the football as far, and as fast as he can in the proper direction and at the proper angle toward the goal posts so as to diminish the likelihood of blocking by the opposing linemen and enhance the probability of a successful scoring kick.

Historically, field goal kicks in professional football, take between two to four seconds from the time the football is hiked (also known as the snap) by the center until the time the kicker actually kicks the ball. This timing range is too narrow for the kicker center, and holder to inherently and comparatively measure time improvement between kicks. The timing is also too narrow to enable a third person to accurately utilize a hand-held stopwatch beginning at the snap, stopping midway at set up (split-time) and stopping again at the exact moment of the kick (total elapsed time). Therefore, an instrument integrally connected to the ball to measure the split-time and total elapsed time is needed. It is therefore of utmost importance that the timing device be highly sensitive and directly integrated with the football holding platforms (at the center and at the holder positions) so as to immediately start the time measurement at the exact moment the ball is snapped by the center to the holder, record a split time when the holder sets up the ball on the holder's platform and immediately stop the time measurement at the exact moment the football actually leaves the holder's platform after the kick. The faster the kick is completed the less likely it is that the kick will be blocked as the difference between a successful and unsuccessful kick may be just hundredths of a second, thus timing segments are critical parameters to track progress.

To accurately simulate oncoming linemen for angle, timing, direction and distant purposes as would exist during a game, the entire offense and defense (21 other players) would be needed on the field for each practice kick by the kicker. This would be logistically impossible in light of the limited practice time available and the number of kicks a field goal kicker, center and holder reasonably need to be proficient. Since the kicker, center, and holder get very little opportunity, except in real game situations, to simultaneously fine-tune and coordinate all the key elements, speed, distance, direction, angle, and coordination of the three players, necessary to a successful kick it is important to have a device that simulates real-time play and provides virtually independent practice time with immediate feedback. This type of practice is not only important at the kicker's home practice field but also, is important for practice at foreign fields when games are "on the road". Thus, the device ideally should be portable and easily set up at a variety of angles and distances from the goalposts to simulate the multitude of positions from which a kicker could be required to kick whether at his own home team field or at foreign fields for away games.

Automated devices for practicing athletic skills have been used for a long time by athletes in a variety of sports. For instance, automated devices are provided for throwing baseballs at baseball batters in conventional batting cage set ups to improve hitting skills. Devices simulating an opponent hitting back tennis balls to a tennis player at various speeds, spins, and directions to improve ground strokes are also known.

Structural and mechanical practice devices have also been produced to hone a variety of football related skills, for instance, U.S. Pat. No. 4,632,395 to Ferrebee discloses a practice device for field goal kicking training which holds the football in position with pressure similar to that of a human holder simulating actual play conditions. U.S. Pat. No. 4,836,542 to Crawley discloses a portable plastic pipe frame structure with flexible net to intercept a kicked ball. These devices contain no mechanism for assessment and feedback to the kicker as to angle i.e. to simulate the opposing team's rushing linemen or timing i.e. how fast the ball is hiked, set up and kicked.

Athletic training timing devices are also known such as U.S. Pat. No. 4,998,727 to Person which discloses a spring-biased switch plate triggered training timer activated by the athlete's foot or the center snapping the ball, to produce an audible signal of selectable duration or which delays the audible signal for selectable period after activation. This device taught by Person is a singular pre-set timing apparatus which provides audible feedback to the athlete via a buzzer. Although the device taught by Person utilizes a switch plate normally in the second or closed position before play is initiated and is activated by the natural motion of the athlete at the beginning of play, it does not possess means to deactivate the timing apparatus as a result of a second natural motion of the athlete, does not comprise means to record and display elapsed time related to the athlete's performance, and is not integrated to function simultaneously with any other mechanical structures contained within the patented device as is the present invention.

U.S. Pat. No. 4,775,151 to Berry is an apparatus for controlling and measuring designated time elements of a football game such as huddle time, time-outs, passes completed, game time and the like. While this device aids in keeping track of time in a particular game, it is not suitable for measuring time or enhancing proficiency related to field goal kicking or any particular athletic skill.

U.S. Pat. No. 4,627,620 to Yang discloses an apparatus for improving an athlete's reflexes, speed and accuracy comprising multiple targets connected to an electronic device. The electronic device randomly selects targets visually and audibly which activates a timing device to measure and display the time which elapses before the athlete physically makes contact with the target, said contact of the target disabling the timer.

Specifically related to football there exists a portable multi-purpose human figure shaped timing device, U.S. Pat. No. 5,294,111 to Block, capable of cradling a football, which is primarily used to notify both offense and defense, audiovisually of the expiration of the delayed and adjustable predetermined rush time. Although, this device, keeps track of the score, the line of scrimmage and the current down, it does not structurally relate in any way to goal posts, the kicking game and proficiency measurement of the kicker, nor does it contain a timing device.

Devices have also been developed for the game of football, to aid in the training of quarterbacks, kickers, etc. For example, U.S. Pat. No. 3,399,892 discloses a mechanical training device to be used by quarterbacks in practicing reception of the ball at the start of play. This device simulates the delivery of the ball from the center to the quarterback of a football team. In U.S. Pat. No. 3,700,238, a machine is disclosed for simulating the snap of the ball from the center to the quarterback. In addition, one or more timers and alarms are provided which time and signal the lapse of time allotted in which the quarterback must execute a play. U.S. Pat. No. 4,261,564 to Holahan discloses an apparatus for practicing punting, passing, or kicking of the football. This device is primarily for use in measuring azimuth angle, equivalent distance and angle of elevation of a ball that is punted, passed or kicked. While these devices aid in the practice of certain aspects of a football game, they are very limited in purpose and function.

There appears to be few, if any, devices suitable for visually timing and by physical obstruction enhance the direction, angle, speed, and distance of a field goal kicker in a manner which as closely as possible simultaneously simulates real game parameters.

The present invention is an integrated timing improvement to an automatic place kicking device of U.S. Pat. No. 3,836,147 (expired) to Shapiro. The Shapiro patent does not disclose a football practice device with timing means and elapsed time display integrated therein. The present invention measures, records and displays the time elapsed from snap at the center's platform to set up at the holder's platform (split-time) and through the time the ball is kicked (total time) and simultaneously simulates the charging lineman by the device's rising net which blocks the kick if the kick is either improperly angled or too slow. At the snap, a switch at the center's pad triggers a timing device mounted on one of the uprights which accurately times the kick from the moment the ball is snapped, i.e. leaves the center's pad, until the ball is set up on the holder's platform (split-time) and continues to measure the total time elapsed until the ball is kicked off the holder's platform, at which point the timing device stops. Said split-time and total elapsed time measurements are measured and visually displayed to the kicker, center, and holder in tenths, hundredths, or even thousandths of a second using timing mechanisms known in the art, eg. stop watch type features. The net and the timer are integrally connected to the center's platform and simultaneously triggered when the football is removed at time of the snap (hiked to holder). The timer is also integrally connected to the holder's platform, which records the time from the snap to set up of the ball by the holder and continues to measure elapsed time until the ball is kicked i.e. leaves the holder's platform. The improvement being a visually integrated resettable timing device and display of the split-time and total elapsed time for the kick, said timing being simultaneously integrated with the snap and kick. This mechanical coordination visually reveals to the kicker, center and holder the time it took to complete each segment of the kicking process, direction of the kick, and whether the kick had enough distance and proper angle to clear the hypothetical lineman (rising net) to have been successful. All of these elements must coexist or the kick will fail to score. Thus, to perform and practice any single element rather than coordinating all parameters in assessing the kick only provides partial information to the kicker. The center and the holder who are critical to a successful kick are also provided timing feedback to enhance their respective skills in this process as well. The integrated timing improvement allows all parameters to combine to reflect a complete and accurate performance picture without the necessity of the presence of all the entire team, only two other players serving as center and holder being necessary, and benefiting from integrated timing feedback to assist in developing a well-coordinated cooperative kicking effort.

BRIEF SUMMARY OF THE INVENTION

According to the present invention the foregoing and other objects and advantages are attained by a horizontal base member which overlies and may be fixed to the surface of a practice field. Two vertical uprights are fixed to respective ends of the board and support there between a cross bar in the form of a barrier member for vertical movement toward and away from the base member to a predetermined vertically raised position which may be at the extreme upper ends of the uprights. Means are provided for moving the cross bar vertically away from the base member at a controlled speed, such means being responsive to the removal of the football from an initial at rest position on the center's platform which preferably is just to the rear of the base board and at the center of same. Depending from and affixed to the cross bar is fixed a light net which simulates charging lineman attempting to block the kick, as it rises from the base board toward the top of the upright. Means responsive to removal of the football from the initial at rest position on the center's platform, when the ball is snapped to the holder activates a timing device and time display and the vertical upward movement of the cross bar. Means responsive to setup of the football by the holder at the final at rest position on the holder's platform and means responsive to removal of the football by the kicker's kick from the final at rest position after set-up on the holder's platform deactivates the timing device and time display. There is also a means for supplying power to the timing means and time display and means for resetting the time display.

In accordance with another aspect of the invention, a means for controlling the speed of movement of the barrier member as it rises from the fully depressed position to fully raised position is provided. Another aspect of the invention provides a moving means which includes a means normally acting on the barrier member to raise it from a depressed position and a means to control the velocity of the cross bar and net as they move up relative to the upright, a latching means to latch the barrier in vertically depressed position and a sensing means for sensing the ball in its initial at rest position for controlling the latching means which when released allows gravity to move the weight downward raising the barrier and starts the timing means and time display.

Yet another aspect of the present invention provides a solenoid operated latching means, an electrical connection of the solenoid to the switch means such that removal of the football from the initial at rest position closes the switch, energizes the solenoid and timing means, and releases the latching means such that the weight moves down raising the barrier and initiating the timing means and time display. Preferably the ball rests on a horizontal, rearwardly directed extension of the base board, the sensing means comprises a normally closed switch. Upper and lower pulleys on the uprights support endless cables coupled to respective ends of the cross bar and further, each carries a weight which is latched to a vertically raised position when the cross bar is at a vertically lowered position. Solenoid controlled latching means maintains the bar in lowered position prior to centering of the ball, at which point in time, the normally open switch closes to energize the solenoid, delatching the cross bar which permits the cross bar to move upward as the weights descend by gravity. Variable brake means in the form of friction brakes preferably control rotation of the pulley and thus the rate of descent of the weight and resultant ascent of the cross bar and the attached net.

A specific embodiment of the football place kick practice device comprises a horizontal base member overlying the surface of a practice field having mounting pins attached thereto at the underside corners of the base member with a pair of uprights fixed to respective ends of base member and supporting therebetween a cross bar in the form of a barrier member for vertical movement towards and away from the base member and to a predetermined vertically raised position which may be at the extreme upper ends of the uprights. There is also present a means for fixating the vertical movement means to the base member and a means for vertically moving the barrier member to said predetermined raised position after a predetermined time lapse using a means for controlling the speed of movement of the barrier member as it rises from fully depressed to fully raised position. There is also a means for initially positioning a football at rest in front of the base member and generally centered relative to the barrier member wherein the moving means comprises means normally acting on/the barrier member to raise the barrier member from a depressed position overlying the barrier member to a raised position above the barrier member. A means for latching said barrier member in vertically depressed position comprises a solenoid operated latch and a means for sensing the presence of a ball in the initial at rest position for controlling the latching means and comprising a switch means. The sensing means is electrically connected to a switch means such that when the ball is removed from the initial at rest position (on the center's platform) the switch means closes energizing the solenoid and the timing means and releasing the latching means. Once the football is placed in the final at rest position at a location at least several feet directly behind said base member and thereafter removed a means responsive to removal of the football from the final at rest position stops the timing means and the visual display visually displaying the time elapsed from snap to set-up and from snap to kick. The time display also includes a means generally known within the art for generating a reset signal to reset the visual time display. Attached to the base member is a means, such as wheels, for facilitating transport of said device on, off and around the football field. As a result of hiking by the center, set-up by the holder and kicking the football by the place kicker, the football is permitted during return movement towards the place kick device to clear the barrier cross bar and net depending upon the timing, distance, elevation, and angle of the place kick, and the elapsed times from snap to set-up and snap to kick are measured and visually displayed.

It is a general object of the present invention to provide an integrated timed field goal and point after touchdown kicking practice device for assessing and improving simultaneously all skill elements critical to successful direction, angle, distance and timing football placekicks while providing immediate accurate, actual kicking time feedback to the kicker, center and holder in a simulated real-time environment.

Another object of the instant invention is to provide a sturdy, stable, yet portable timed field goal kicking practice device for football place kickers to use without convening the entire football team and which simulates circumstances encountered during actual game play and helps coordinate the actions of the center, holder and kicker.

Yet another object of the present invention is to provide a time-integrated device that measures then allows the kicker, center and holder to immediately see on a visual time display the split-time, from snap to set up and total elapsed time, from snap to kick, for each practice kick.

Yet another object of the present invention is to provide a new, improved, and time-integrated practice apparatus of the character described which is useful for training and coordinating the skills and activities of the center, holder, and kicker in the art of extra point and field goal kicking.

It is a further object of the present invention to provide an integrated timing device which is activated and deactivated by the natural motion of the athlete(s).

Another object of the present invention is to provide a portable practice apparatus of the character described which includes means for measuring and displaying elapsed time associated with kicking field goals and points after touchdown in the game of kicking football.

Another object of the present inventions is to provide a time integrated field goal kicking practice device wherein the timing display can be readily reset for successive operations.

Other objects and advantages of the invention will become apparent upon reference to the drawings and upon reading the following detailed description.

DESCRIPTION OF THE PREFERRED EMBODIMENTS

Figures 1, 3:
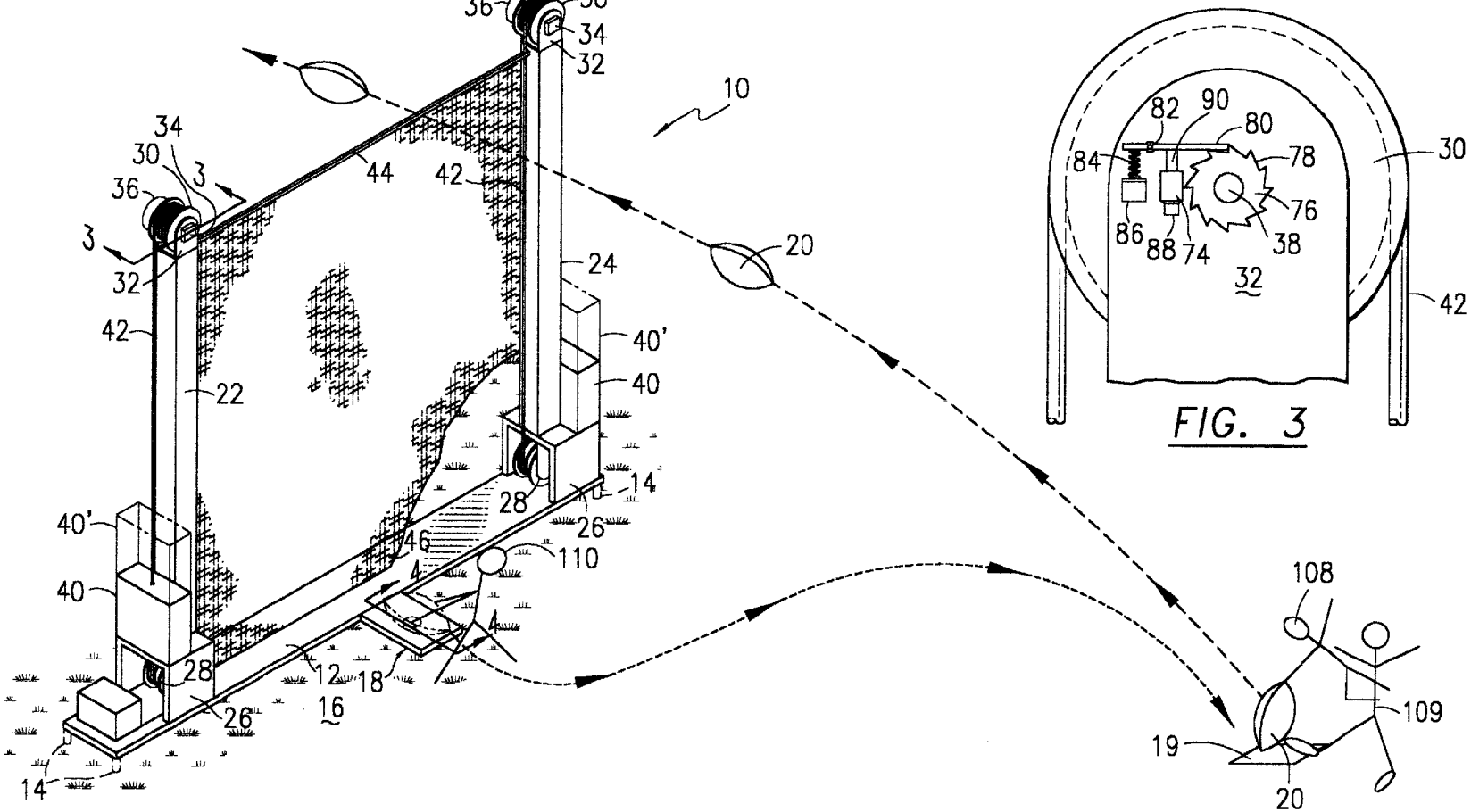
FIG. 1 is a perspective view of one form of the auto place kick device of the present invention.
FIG. 3 is a sectional elevational view of a portion of the device of FIG. 1 taken along line 3—3 of FIG. 1.

Referring now to the drawings and in particular, FIG. 1, illustrates one form of the football place kick practice device as it would be in use. The device 10 comprises a horizontal base member 12 having four depending mounting pins 14 at respective corners for relatively stable fixing of the base member to the surface of the practice field 16 at a given position. These pins are height adjustable such as by screwing them up and down at the four corners of the device, to the height desired and can rest on top of the field surface or can be pressed into the ground for greater stability, depending upon the field surface and amount of stability determined to be needed. A rearward projection, center's platform 18, extends from the base member a distance which is at least as long as the length of a conventional football 20 indicated in broken line fashion. Fixed to opposite ends of the base member 12 are uprights 22 and 24 which are mounted to the base member by means of inverted U-shaped mounts 26, each of which supports a lower pulley 28. Attached to the U-Shaped mounts 26 is a time display unit 27 shown in the preferable digital format for ease in reading and accuracy of measurement although analog format may also be used. The time display 27 should be of sufficient size as to display numbers easily read from as far away as the kicker's location immediately after the kick. At the upper ends of the uprights 22 and 24, there are mounted for rotation, upper pulleys 30 of a size corresponding to those of lower pulleys 28 by way of U-shaped mounting blocks 32 whose open ends are directed upwardly. The mounting blocks 32 are provided with solenoid controlled pawl and ratchet locking or latching mechanisms 34 on the rear side of the device 10, while on the opposite side are provided conventional variably adjustable friction brakes 36 of conventional construction, whereby, frictional loading to shafts 38, FIG. 3, may be achieved for controlling the rotational velocity of the pulleys as determined by weights 40 which are coupled to respective ends of endless cable 42 which in turn are reeved on the pulleys 28 and 30 for each of the uprights 22 and 24. Extending between the uprights is a barrier member or cross bar 44 whose ends are fixed to respective cables 42 at a predetermined position on the endless cable such that the cross bar 44 is in the fully raised position as seen in FIG. 1, when the actuator weights 40 rest on the top of U-shaped mounts 26 which support the uprights 22 and 24. A rectangular, flexible and relatively light net 46 of suitable mesh is fixed at its upper edge to the cross bar 44 and depends therefrom. Net 46 is of a width generally on the order of the distance between the inside runs of cables 42 such that when the cross bar 44 is raised to its maximum vertical extent, as evidenced in FIG. 1, the area defined by the base board 12 and the uprights 22 and 24 is virtually covered by the screen so as to constitute a barrier for a kicked football.

Figure 2:
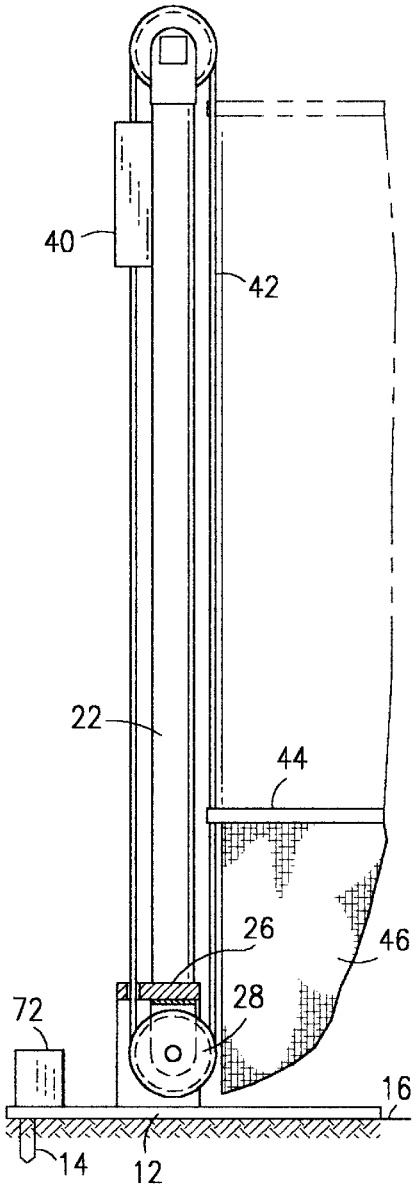
FIG. 2 is a rear elevational view of a portion of the device of FIG. 1, partially in section, illustrating the endless cable support of the cross bar and the actuator weights forming components thereof.

By holding onto the cables 42, the cross bar 44 and the net 46 may be vertically depressed, as best seen in FIG. 2, which in turn causes the weights 40 to move to their vertically raised position; the raised position for the weights and the depressed position for the cross bar 44 and net 46 being seen in FIG. 2 in full line position, while the depressed position of the weight and the raised position of the net as seen in FIG. 2 is indicated by the broken lines. Movement from the full line position shown in FIG. 2 to the dotted line position therein, is achieved automatically under the control of the snap or centering of football 20 in such a manner that the cross bar and net will move upward at a controlled rate of speed and reach a predetermined vertically upright position and simultaneously the timing circuit 100 will be activated such that normally a good kick achieved by the place kicker which is properly timed and has the proper direction, distance and elevation will clear the barrier formed thereby, as shown by arrowed dashed line in FIG. 1, while to the contrary, if the kicking process (hike, set up and kick) is too slow, or the angle of elevation of the kick as it leaves the kicker's foot is too low, the barrier will intercept the ball and the total elapsed time will be indicating immediately to the kicker the deficiencies in that particular kick and simultaneously the timing device will measure and display the split-time and total elapsed time for the kick.

Figure 5:
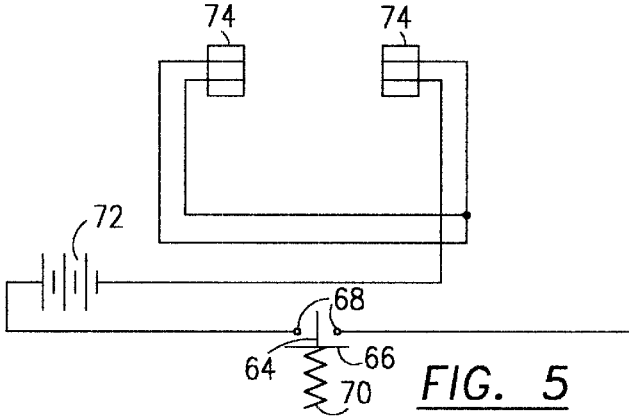
FIG. 5 is an electrical schematic of the solenoid control circuit associated with the device of FIG. 1.

In this respect, the ball 20 as it is positioned properly on center's platform 18 or its equivalent, will be centered with respect to a circular button or disc 50 which is spring biased into protruding position relative to a circular opening 52. The extension may comprise a hollow rectangular plate formed of an upper sheet 54 spaced some distance above the lower sheet 56 and permitting within the cavity 58 formed thereby, the positioning of a normally closed push button switch 60 with a coil spring 62 concentrically surrounding the same, being under compression and bearing respectively on disc 50 and the lower sheet. The weight of the football 20 is sufficient to depress the disc 50 to a position generally flush with the upper sheet 54 of the plate 18 or slightly below the same such that the push button switch follower actuator pin 64 is depressed to open the switch contacts 68, that is, to move the movable switch contact 66, FIG. 5, to open position relative to fixed contacts 68 against the bias of a compression spring 70 within the housing of the push button switch 60. A battery 72 which may be supported on the base member 12 to the outside of one of the posts such as post 22, is connected to switch contacts 68 and to solenoid coils 74 such that the depression of the microswitch push button 66 results in opening the normally closed switch 60 and de-energizing solenoid coils 74.

FIG. 3 illustrates more fully one of the solenoid operated pawl and ratchet locking mechanisms 34, with the cover removed. Pulley support shaft 38 has fixed thereto, a ratchet wheel 76 whose ratchet teeth 78 are selectively engaged by spring biased pawl 80 which pivots about a pin 82 and is spring biased by coil spring 84 positioned between the end of the pawl 80 opposite that engaging ratchet wheel and a fixed stop 86 mounted to the side of block 32 such that the spring 84 normally biases the pawl into engagement with one of ratchet teeth 78 and prevents rotation of pulley 30 and the endless cable 42 attached thereto. A small L-shaped metal bracket 88 supports the solenoid coil 74 which in turn houses an armature 90 having an outer end bearing on pawl 80. Upon energization of coils 74, each pawl 80 is rotated counterclockwise about the pivot axis defined by the mounting pin 82, forcing the pawls 80 to be disengaged from the ratchet wheels 76 and permitting the weights 40 to drop from the raised position of FIG. 2 to a position where they impact against the top of the U-shaped mounts 26. During this time, cross bar 44 and net 46 rise vertically. The impact of the weights 40 against their mounts 26 indicates audibly the fact that the cross bar 44 and net 46 are raised to full barrier position.

Rather than employ a battery energized microswitch controlled, solenoid operated pawl and ratchet as the latching or locking means for the cross bar in its depressed position, and the weights in their raised positions, these elements could be replaced by a completely mechanical system, wherein the position of the football is sufficient to mechanically latch the weights in raised position and cross bar in lowered position. Further additional actuator weights could be added as as at 40' to change the speed of the rising cross bar 44 and net 46. Alternatively, this velocity could be varied by adjusting the friction brakes 36 acting on pulley shafts 38, if such are provided. In addition to the battery 72 acting to energize the solenoid coils 74, the battery could conceivably energize an electric drive motor (not shown) for positively driving the endless cables 42 with additional sensing means sensing the movement of the net to its uppermost position for terminating the energization to the drive motor, for example.

Figure 6:
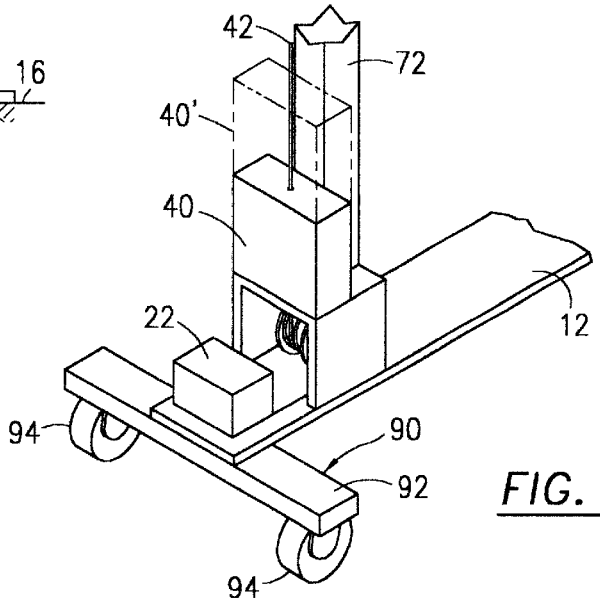
FIG. 6 is a perspective view of one side of the device of FIG. 1 illustrating the use of removable carriages for transporting the device to and from the practice field.

FIG. 6 illustrates the utilization of one of a pair of carriages 90 which are detachably affixed to the outer ends of base member 12, preferably through the use of the mounting pins 14. Each carriage 90 consists of a rectangular beam 92 having wheels 94 at each end and thus permitting the device 10 to be transported to and from the field. Where the impact force of the ball contacting either the cross bar 44 or net 46 is insufficient to topple the device, the necessity for removing the carriages 90 at each end of the device and staking to the ground would be eliminated. The stability of the device may be enhanced by increasing the length of the beams 92. The uprights 22 and 24, the base member 12, as well as the U-shaped mounts 26 may be readily formed of wood, metal, or PVC type material keeping in mind portability and the degree of abuse to which the device may be subjected during use.

Figure 4:
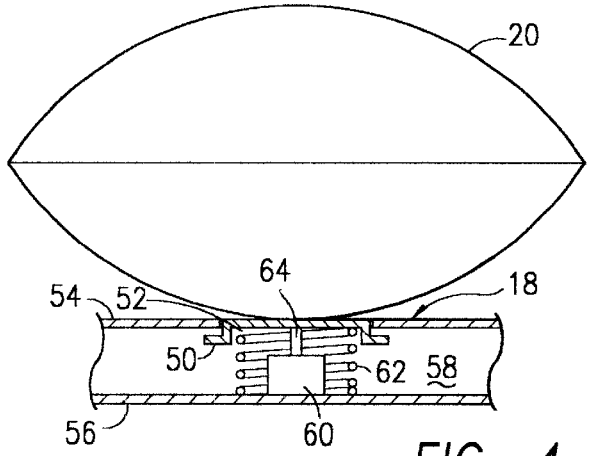
FIG. 4 is a sectional view of a portion of the device taken about line 4—4 of FIG. 1.
Figure 7:
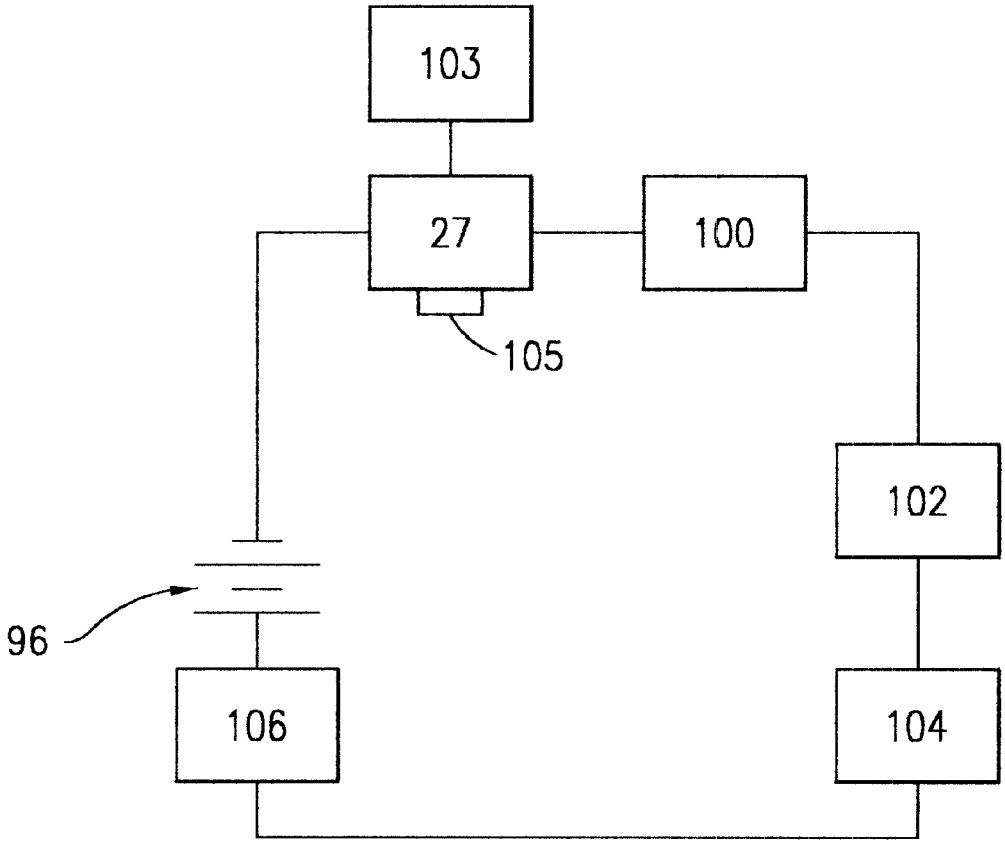
FIG. 7 is an electrical schematic depicting the circuitry between the center's pad (hike switch), holder's pad (kick switch), clock, net switch and the time display.

FIG. 7 illustrates an electrical schematic of the circuitry between the center's platform 18 (hike switch) 102, holder's platform 19 (kick switch) 104, timing circuit 100, time display 27, time display re-set 103 and the net switch 106. The center's platform contains a hike switch 102 shown in FIG. 4. At the time the ball 20 is removed from the hike switch 102 when the center player 110 snaps the ball, power from the power source, eg. battery or the like turns on the net solenoid, the timing circuit 100 and the time display 27. The holder 108, as shown by arrowed dotted line in FIG. 1, catches the hiked ball and sets-up the ball in kicking position on the holder's platform 19 containing a kick switch. The hike switch 102 transitions from the first position to the second position thereby simultaneously activating both the raising of the cross bar and net, and the timing circuit the time display. The kick switch 104 is closed initially and conducts current when the hike switch 102 is activated (closed). The kick switch includes a current/circuit device that senses or is activated whenever a ball is placed on the kick switch, while still conducting current. Once the ball is sensed in place by the kick switch 104 on the holder's platform, the split-time (time from hike to set-up of ball) is measured and recorded however, the net continues to rise and time continues to be measured and recorded. The kicker 109 kicks the ball from the remotely located holder's platform 19, opening the kick switch 104 and stopping current to the net switch 106, timing circuit 100, and time-display 27. The time display 27 reveals both split-time from hike to set-up and total elapsed time from the hike to the kick. Within and connected to the time display is a time display re-set. A reset button 105 located on the time display 27 is connected to the reset circuit and when the button 105 is manually depressed the previously recorded time is cleared from the time display returning it to 00:00. Such reset configuration within time displays is readily known in the art. A portable power supply 96 is provided for powering the circuit which can be A/C, photoelectric, battery, radio communication, infrared or other methods known in the art.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A football place kick practice device comprising:

a horizontal base member overlying the surface of a practice field;

upright means fixed to said base member and supporting a barrier member for vertical movement towards and away from said base member and to a predetermined vertically raised position;

means for moving said barrier member vertically to said predetermined raised position after a predetermined time lapse;

means for initially positioning a football at rest in front of said base member and generally centered relative to said barrier member;

means for positioning a football in the final at rest position at a location remote to and directly behind said base member;

means for measuring the time elapsed from removal of a football from the initial at rest position until placement of a football in the final at rest position, and continuing until removal of a football from the final at rest position;

means responsive to removal of a football from said initial at rest position for actuating said barrier member moving means and actuating said timing means;

means for supplying power to said device;

means for visually displaying the time elapsed from removal of a football from the initial at rest position until placement of a football in the final at rest position and from time of placement of a football in the initial at rest position until removal of a football from the final at rest position; and means responsive to removal of a football from the final at rest position for stopping said timing means and visual display means;

whereby, as the result of kicking a football by said place kicker, (a football) is permitted during return movement towards said device to clear said barrier member depending upon the timing, distance, elevation, and angle of the place kick, and the elapsed times for set-up and kick are measured and visually displayed.

2. The device as in claim 1, further comprising means for controlling the speed of movement of said barrier member as it rises from fully depressed to fully raised position.

3. The device as in claim 1, wherein said visual time display means comprises a means for generating a reset signal to reset said visual display means.

4. The place kick device as in claim 2, wherein said moving means comprises means normally acting on said barrier member to raise said barrier member from a depressed position overlying said barrier member to a raised position above the same, latching means normally latching said barrier member in vertically depressed position, and sensing means for sensing the presence of a football in said initial at rest position for controlling said latching means and resetting said timing means and a time display.

5. The place kick device as in claim 1, further comprising a pair of carriages detachably affixed to the outer ends of said base member, said carriages having wheels attached thereto to facilitate transport of the device.

6. The place kick device as claimed in claim 4, wherein said means for initially positioning a football at rest in front of said base member comprises a horizontal, rearward extension of said base member, said sensing means comprises a normally closed switch carried by said extension, said latching means comprises a solenoid operated latch, and means electrically connecting said solenoid to said switch means such that removal of (a football) from said initial at rest position closes said switch, energizing said solenoid, releasing said latching means and energizing said timing means.

7. The place kick practice device as claimed in claim 2, wherein said means for moving said barrier member comprises a weight operatively connected to said barrier member and movable to a raised position when said barrier member is moved to a vertically depressed position, whereby, upon release of said latching means, said weight moves downwardly as a result of gravity and raises said barrier member.

8. The place kick practice device as claimed in claim 7, wherein said upright means comprises a pair of vertical uprights fixed to the respective ends of said base member, said base member comprises a horizontal board fixed to the surface of a field, said uprights include pulleys at their upper and lower ends respectively, and said means for supporting said barrier member comprises an endless cable reeved on said pulley means for each vertical upright, a weight is fixed to each endless cable at one position thereon and said barrier member comprises a cross bar fixed at respective ends to said endless cable such that when said cross bar is at its lowermost position, and weight is at its fully raised position, and wherein a screen is fixed at one edge of said cross bar and extends across the space defined by said uprights when said cross bar is moved to its fully upright raised position.

9. The place kick practice device as claimed in claim 8, further comprising friction brakes operatively associated with at least one of said pulleys for each upright to control the velocity of said cross bar and said net as they move relative to said upright.

10. The place kick practice device as claimed in claim 4, wherein said means for moving said barrier member comprises a weight operatively connected to said barrier member and movable to a raised position when said barrier member is moved to said vertically depressed position whereby, upon release of said latching means, said weight moves downwardly as a result of gravity and raises said barrier member.

11. The place kick practice device in claim 1, further comprising mounting pins removably attachable at the four corners of the device, having a means for adjusting the height of said pins, to enhance stability of the base member to the ground.

12. The place kick device as in claim 4, wherein said means for positioning a football in the final at rest position in a location remote to and at least a few feet directly behind said base member comprises a platform having a sensing means and means electrically connecting said sensing means to said switch means such that placement of (a football) in the final at rest position triggers the timing means to measure and display the then elapsed time from snap to set-up of a football and removal of (a football) from said final at rest position deenergizes the timing means and the visual time display means so as to measure and display total time elapsed from snap top kick.

13. The place kick device as in claim 4, wherein said means for positioning a football in the final at rest position in a location remote to and at least a few feet directly behind said base member comprises a platform having a sensing means and means electrically connecting said sensing means to a switch means such that placement of (a football) in the final at rest position triggers the timing means to measure and display the then elapsed time from snap to set-up of a football and removal of (a football) from said final at rest position de-energizes the timing means and the visual time display means so as to measure and display total time elapsed from snap top kick.

14. A football place kick practice device comprising:

a horizontal base member overlying the surface of a practice field having mounting pins attached thereto at the underside corners of the respective ends of said base member;

upright means fixed to said base member and supporting a barrier member for vertical movement towards and away from said base member and to a predetermined vertically raised position;

means for fixating said means for vertical movement to said base member;

means for moving said barrier member vertically to said predetermined raised position after a predetermined time lapse;

means for controlling the speed of movement of said barrier member as it rises from fully depressed to fully raised position;

means for initially positioning a football at rest in front of said base member and generally centered relative to said barrier member wherein said moving means comprises means normally acting on said barrier member to raise said barrier member from a depressed position overlying said barrier member to a raised position above the same;

latching means for latching said barrier member in vertically depressed position comprising a solenoid operated latch;

sensing means for sensing the presence of a football in said initial at rest position for controlling said latching means and comprising a switch means;

means electrically connecting said sensing means to said switch means such that removal of (a football) from said initial at rest position closes said switch means energizing said solenoid and said timing means and releasing said latching means;

means for positioning a football in the final at rest position at a location at least several feet directly behind said base member;

means for measuring elapsed time;

means responsive for removal for a football from said initial at rest position for actuating said barrier member moving means and said timing means;

means for supplying power to said device;

means responsive for removal of a football from said final at rest position for stopping said timing means and visual display means;

the means for visually displaying the time elapsed wherein said display means comprises a means for generating a reset signal to reset said visual display means; and means attached to said base member for facilitating transport of said device on, off and around a practice field, whereby, as a result of hiking by the center, setup by the holder and kicking the football by the place kicker, a football is permitted during return movement towards said device to clear said barrier member depending upon the timing, distance, elevation, and angle of the place kick, and the elapsed times from snap to set-up and snap to kick are measured and visually displayed.

* * * * *